US010488168B2

(12) United States Patent
Kerswill

(10) Patent No.: US 10,488,168 B2
(45) Date of Patent: Nov. 26, 2019

(54) WEARABLE PAINTBALL DISPENSING BAG

(71) Applicant: Richard Kerswill, Pennsville, NJ (US)

(72) Inventor: Richard Kerswill, Pennsville, NJ (US)

( * ) Notice: Subject to any disclaimer, the term of this patent is extended or adjusted under 35 U.S.C. 154(b) by 84 days.

(21) Appl. No.: 15/062,764

(22) Filed: Mar. 7, 2016

(65) Prior Publication Data

US 2017/0254627 A1 Sep. 7, 2017

(51) Int. Cl.
*F42B 39/02* (2006.01)
*A45F 3/04* (2006.01)
*A63B 47/00* (2006.01)

(52) U.S. Cl.
CPC ..... *F42B 39/02* (2013.01); *A45F 3/04* (2013.01); *A63B 47/001* (2013.01)

(58) Field of Classification Search
CPC ..... A63B 47/001; A63B 47/002; A63B 47/00; A63B 57/20; F42B 39/02
USPC ..... 221/185, 310, 306–307; 222/175; 224/919, 681, 627–659
See application file for complete search history.

(56) References Cited

U.S. PATENT DOCUMENTS 2,599,118 A * 6/1952 McMillan ..... A01C 15/02 111/95
5,826,746 A * 10/1998 Ash, Jr. ..... A45F 3/04 221/185
5,826,771 A * 10/1998 Peng ..... A45F 3/04 224/651
5,975,293 A * 11/1999 Fowler ..... A63B 71/0045 206/315.1
6,053,386 A * 4/2000 Reynolds ..... A63B 47/001 221/185
6,055,975 A * 5/2000 Gallagher ..... F41B 11/52 124/49
D454,685 S 3/2002 Parks et al.
6,446,851 B1 9/2002 Parks et al.
6,962,278 B2 11/2005 Obatake
6,981,493 B1 * 1/2006 Poteracke ..... F41B 11/50 124/45
7,100,810 B1 9/2006 Bosch et al.
7,559,445 B1 7/2009 Kulp
7,810,350 B2 * 10/2010 Shelton ..... A45F 3/04 62/371
8,079,503 B1 * 12/2011 Yeates ..... A45C 7/0086 224/268

(Continued)

*Primary Examiner* — Scott T McNurlen

(57) ABSTRACT

A wearable paintball dispensing bag for storing paintballs and loading the paintballs to a hopper of a paintball gun. The wearable paintball dispensing bag includes arcuate flexible internal compartments and first fastening members. The arcuate flexible internal compartments extend from a top section to a bottom section of the wearable paintball dispensing bag. A first opening of the arcuate flexible internal compartments receives the paintballs and a second opening of each of the arcuate flexible internal compartments releases the paintballs. The first fastening members are positioned proximal to the second opening of the arcuate flexible internal compartments for releasably sealing the second opening of the wearable paintball dispensing bag. Unfastening the first fastening members releases the paintballs into the hopper of the paintball gun. The second opening has a spring element configured to be squeezed open in order to release the paintballs after unfastening the first fastening members.

4 Claims, 4 Drawing Sheets

(56) References Cited

U.S. PATENT DOCUMENTS

| | | | | |
|---|---|---|---|---|
| 2002/0179656 | A1* | 12/2002 | Price | F42B 39/02<br>224/196 |
| 2004/0211685 | A1* | 10/2004 | Brock | F42B 39/02<br>206/315.1 |
| 2006/0226180 | A1* | 10/2006 | Hubbell | A45F 3/00<br>224/148.2 |
| 2008/0121675 | A1 | 5/2008 | Callanta | |
| 2010/0006616 | A1 | 1/2010 | Orr et al. | |
| 2010/0096426 | A1 | 4/2010 | Tarnawiecki | |

* cited by examiner

WEARABLE PAINTBALL DISPENSING BAG

BACKGROUND

Paintball is a recreational activity in which participants compete, individually or in teams, to eliminate opponents by tagging them with frangible capsules filled with water-soluble dye propelled by a paintball marker or a paintball gun. With increase in popularity, paintball has progressed to become a professional sport in several countries, with tournaments being held across the world. Conventionally, participants of paintball require three basic pieces of equipment for playing the game which are a paintball marker or gun, paintballs, and a mask or goggles. The paintballs are loaded into a hopper positioned on the paintball marker. Typically, a paintball marker holds about 200-250 paintballs. In a typical paintball game, a participant uses about 1000 paintballs.

Traditionally, paintballs are stored in containers referred to as 'pods' or 'paintball pods'. The paintball pods are cylindrical and have a lid or cap to prevent loss of paintballs. When a participant runs out of paintballs, he/she must load a fresh set of paintballs from a pod to continue in the game. The participant must carry multiple pods and open each one individually to reload the marker. This is time consuming in a fast-paced environment such as a paintball game and may result in the participant being marked by a rival and ultimately losing the game.

Furthermore, when playing paintball aggressively, the task of reloading the paintball marker may not be carried out properly. In some applications, paintball is used by military forces, law enforcement, para-military, and security organizations to supplement training as well as simulate hostile scenarios. For such applications, reloading the paintball marker must be done rapidly. Additionally, paintballs must not be lost due to fumbling or improper loading. Typically, when a participant loads a paintball marker from conventional paintball pods, a few paintballs may fall to the ground without being inserted into the paintball hopper. Moreover, the participant could drop the pod and loose many paintballs.

Hence, there is a long felt but unresolved need for a bag that stores paintballs and loads the paintballs to a paintball marker or gun rapidly. Furthermore, there is a need for a bag that enables loading of the paintballs into the paintball marker without spilling or losing any of the stored paintballs.

SUMMARY OF THE INVENTION

This summary is provided to introduce a selection of concepts in a simplified form that are further disclosed in the detailed description of the invention. This summary is not intended to identify key or essential inventive concepts of the claimed subject matter, nor is it intended for determining the scope of the claimed subject matter.

The wearable paintball dispensing bag disclosed herein addresses the above mentioned need for a bag that stores paintballs and loads the paintballs to a paintball marker or gun rapidly. Furthermore, the wearable paintball dispensing bag disclosed herein addresses the above mentioned need for a bag that enables loading of the paintballs into the paintball marker without spilling or losing any of the stored paintballs. The wearable paintball dispensing bag disclosed herein stores paintballs and loads the paintballs to a paintball gun without having to remove the bag from the user's shoulder. The wearable paintball dispensing bag includes one or more arcuate flexible internal compartments and one or more first fastening members. The arcuate flexible internal compartments extend from a top section to a bottom section of the wearable paintball dispensing bag. A first opening of the one or more arcuate flexible internal compartments receives the paintballs and a second opening of each of the arcuate flexible internal compartments releases the paintballs. The first fastening members are positioned proximal to the second opening of the arcuate flexible internal compartments for releasably sealing the second opening of the wearable paintball dispensing bag. Unfastening the first fastening members releases the paintballs into the hopper of the paintball gun. In an embodiment, the second opening has a spring release. When the second opening is squeezed open, the spring compresses to release the paintballs after unfastening the first fastening members.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION OF THE INVENTION

Figure 1:
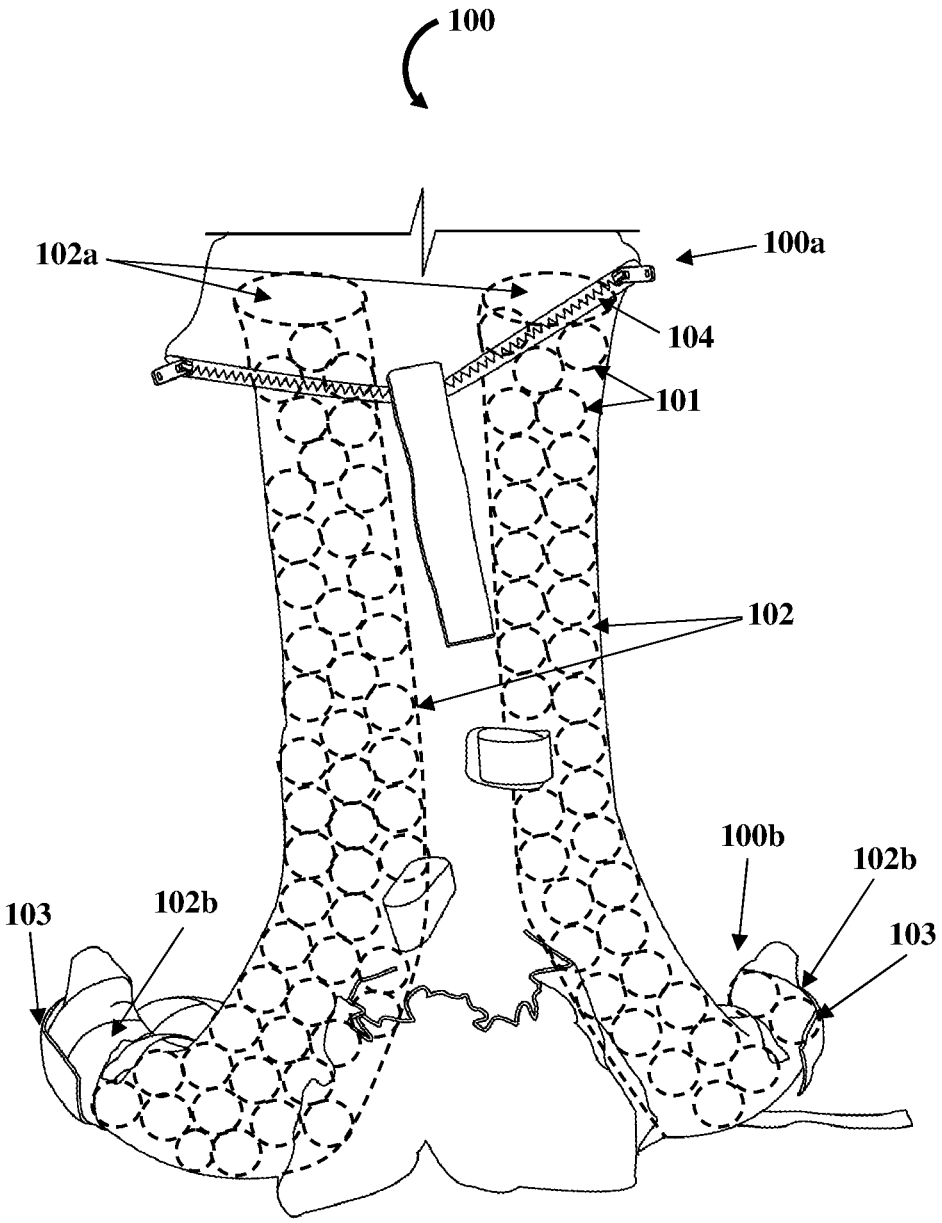
FIG. 1 exemplarily illustrates a front perspective view of a wearable paintball dispensing bag.

FIG. 1 exemplarily illustrates a front perspective view of a wearable paintball dispensing bag 100. The wearable paintball dispensing bag 100 is configured to store paintballs 101 and for loading the paintballs 101 to a hopper of a paintball gun. The wearable paintball dispensing bag 100 comprises one or more arcuate flexible internal compartments 102 and one or more first fastening members 103. As used herein, "fastening member" refers to a device used to bind the edges of the components of the wearable paintball dispensing bag 100. In an embodiment, the fastening members used are zippers. In other embodiments, the fastening members used are, for example, snap fasteners, buttons, clasps, hook and loop fasteners such as Velcro® of Velcro Industries B.V. LLC. In an embodiment, the wearable paintball dispensing bag 100 comprises two arcuate flexible internal compartments 102. The arcuate flexible internal compartments 102 extend from a top section 100*a* of the wearable paintball dispensing bag 100 to a bottom section 100*b* of the wearable paintball dispensing bag 100. A first opening 102*a* of each of the arcuate flexible internal compartments 102 is configured to receive the paintballs 101 and a second opening 102*b* of each of the arcuate flexible internal compartments 102 releases the paintballs 101. The first openings 102*a* are accessed by unfastening a second fastening member 104 positioned near the top section 100*a* of the wearable paintball dispensing bag 100. In an embodiment, the second fastening member 104 is a zipper. The first fastening member 103 is positioned proximal to the second opening 102*b* of the arcuate flexible internal compartments 102. The first fastening members 103 releasably seal the second opening 102*b* of the arcuate flexible internal compartments 102 of the wearable paintball dispensing bag 100. The paintballs 101 are released when the first fastening members 103 are unfastened. In an embodiment, the first fastening members 103 are hook and loop fasteners such as Velcro® of Velcro Industries B.V. LLC. In an embodiment, the second opening 102*b* has a spring release. When the second opening 102*b* is squeezed open, the spring compresses to release the paintballs after unfastening the first fastening members 103.

Figure 2:
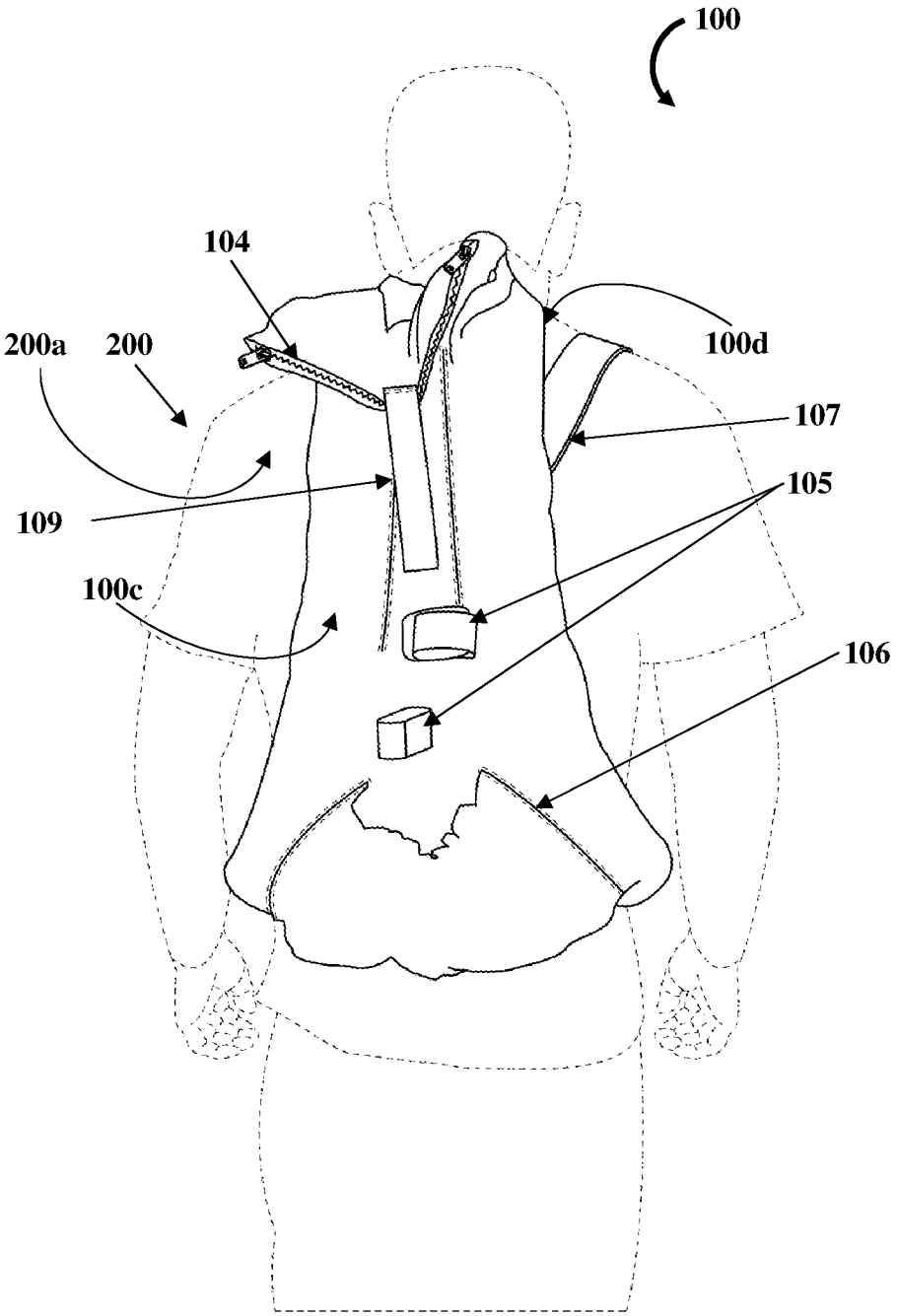
FIG. 2 exemplarily illustrates a front view of a wearable paintball dispensing bag, showing the wearable paintball dispensing bag worn by a user.

FIG. 2 exemplarily illustrates a front elevation view of a wearable paintball dispensing bag 100, showing the wearable paintball dispensing bag 100 worn by a user 200. In an embodiment, the wearable paintball dispensing bag 100 comprises multiple straps 105 configured as holders. The wearable paintball dispensing bag 100 also comprises one or more pouches 106. In an embodiment, the wearable paintball dispensing bag comprises one pouch 106. The pouch 106 and the straps 105 are positioned on a front surface 100*c* of the wearable paintball dispensing bag 100. In an embodiment, the second fastening member 104 is fastened onto the front surface 100*c* of the wearable paintball dispensing bag 100 using a third fastening member 109, for example, a hook and loop fastener. The user 200 wears the wearable paintball dispensing bag 100 using one or more shoulder straps 107 positioned on a rear surface 100*d* of the wearable paintball dispensing bag 100. In an embodiment, the wearable paintball dispensing bag 100 comprises two shoulder straps 107. The wearable paintball dispensing bag 100 is attached to a user contact surface 200*a*, for example, a back of a user, using the shoulder straps 107.

Figure 3:
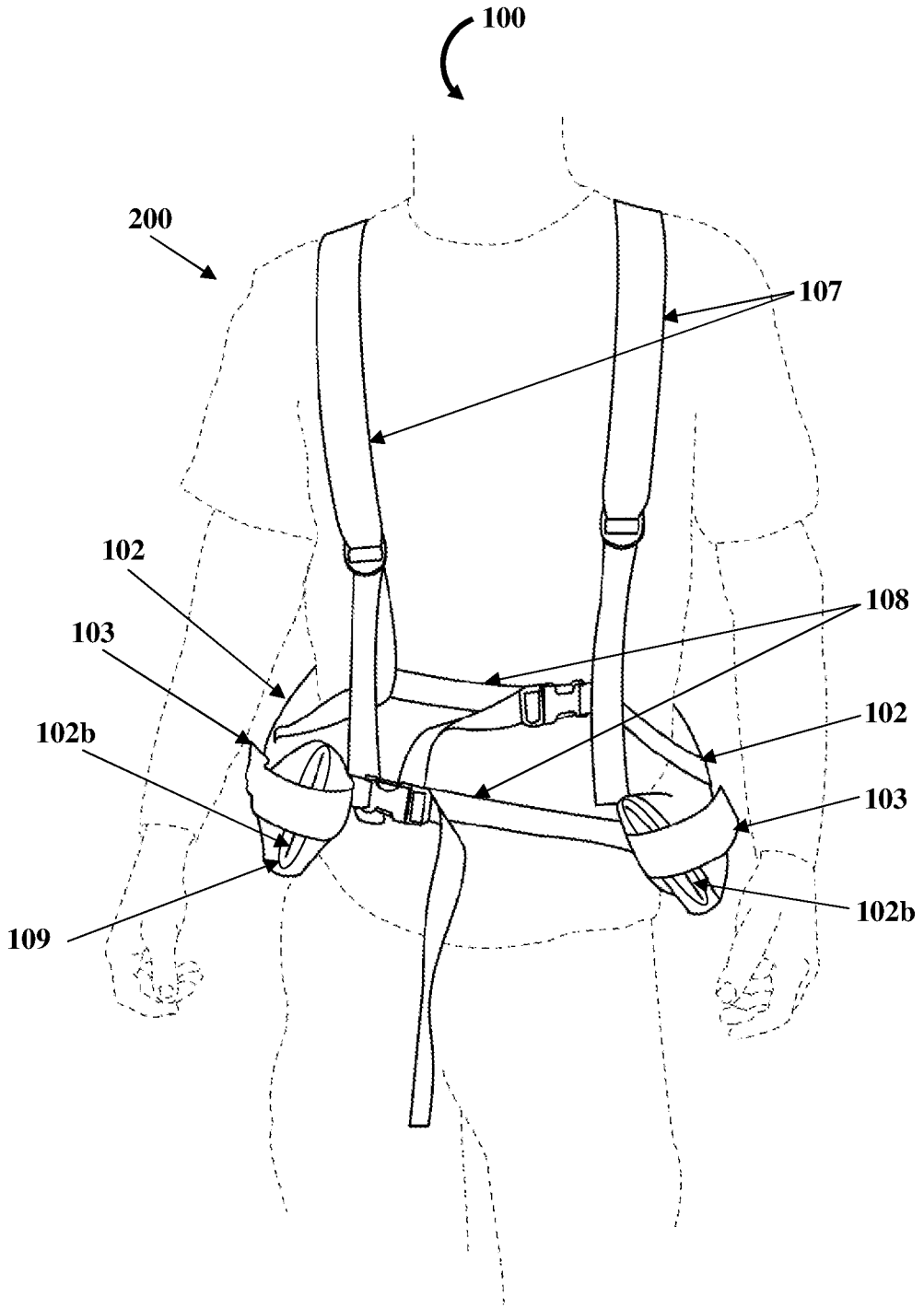
FIG. 3 exemplarily illustrates a rear view of a wearable paintball dispensing bag, showing the wearable paintball dispensing bag worn by a user.

FIG. 3 exemplarily illustrates a rear elevation view of a wearable paintball dispensing bag 100, showing the wearable paintball dispensing bag 100 worn by the user 200. The wearable paintball dispensing bag 100 is worn by the user 200 using the shoulder straps 107 positioned on the rear surface 100*d* of the wearable paintball dispensing bag 100 as disclosed in the detailed description of FIG. 2. In an embodiment, the wearable paintball dispensing bag 100 comprises auxiliary waist straps 108 for holding the wearable paintball dispensing bag 100 securely to the user 200. Consider the example of the user 200 wishing to reload paintballs 101, exemplarily illustrated in FIG. 1, into a paintball gun. The user 200 unfastens the first fastening member 103 and squeezes the second opening 102*b*. When the second opening 102*b* is squeezed open, the spring compresses to release the paintballs after unfastening the first fastening members 103. As a result of this action, the second opening 102*b* of the arcuate flexible internal compartments 102 opens and releases the paintballs 101. In an embodiment, the wearable paintball dispensing bag 100 comprises a spring element 109 as disclosed in detail in the detailed description of FIG. 4.

Figure 4:
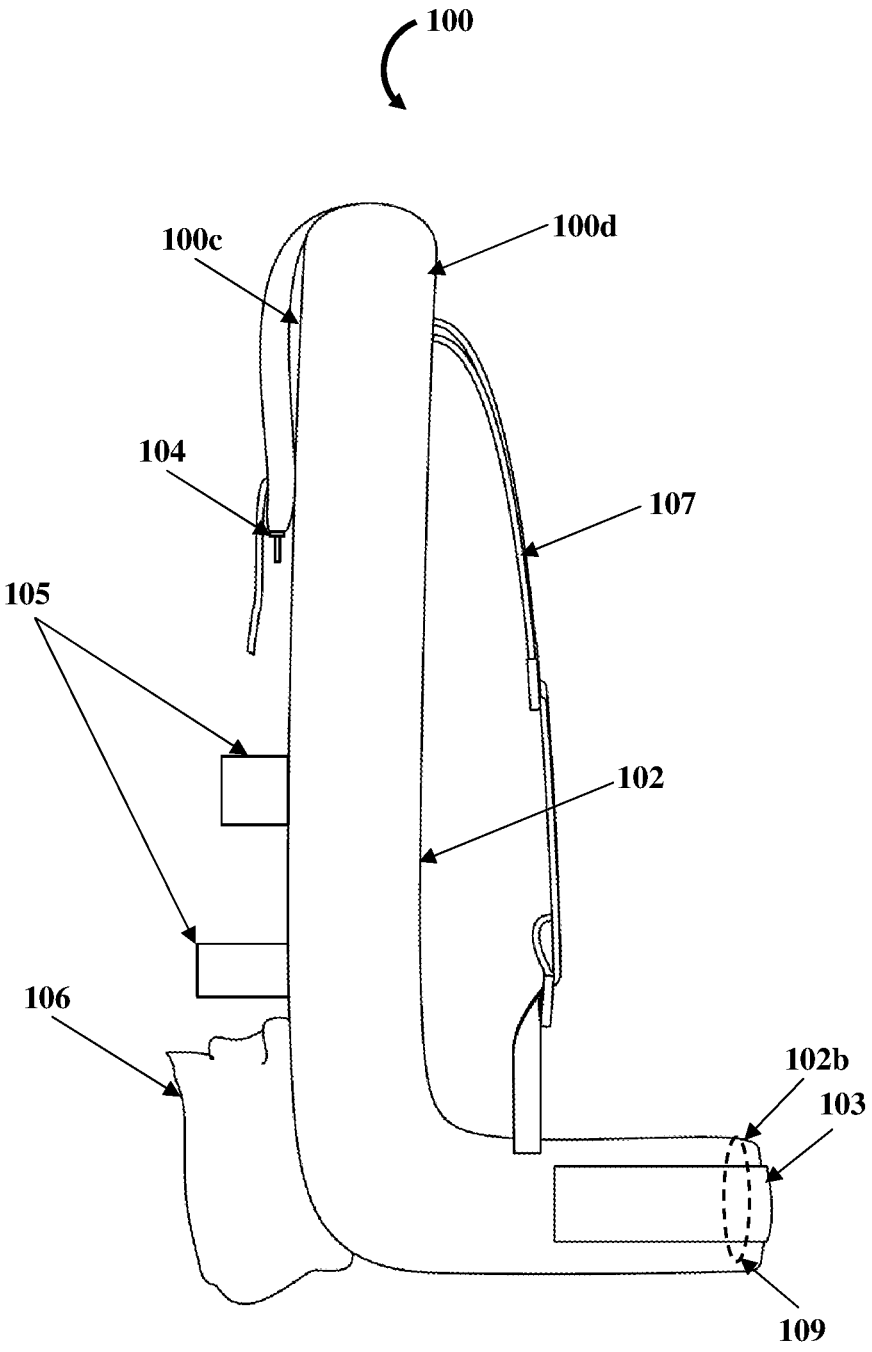
FIG. 4 exemplarily illustrates a right side elevation view of a wearable paintball dispensing bag.

FIG. 4 exemplarily illustrates a right side elevation view of a wearable paintball dispensing bag 100. The arcuate flexible internal compartments 102 extend from the top section 100*a* to the bottom section 100*b* of the wearable paintball dispensing bag 100 as exemplarily illustrated in FIG. 1. In an embodiment, the first fastening member 103 seals the second opening 102*b* of the arcuate flexible internal compartments 102 and prevents the release of the stored paintballs 101, exemplarily illustrated in FIG. 1. In an embodiment, the multiple straps 105 and the pouch 106 are positioned on the front surface 100*c* of the wearable paintball dispensing bag 100. The pouch 106 and the multiple straps 105 enable the user 200 to hold multiple objects, for example, goggles, water bottles, grenades, protective gear, etc. The shoulder straps 107 are positioned on the rear surface 100*d* of the wearable paintball dispensing bag 100. The rear surface 100*d* of the wearable paintball dispensing bag 100 is in contact with the user contact surface 200*a*, as exemplarily illustrated in FIG. 2. In an embodiment, the paintball dispensing bag comprises a spring element 109 positioned proximal to the second opening 102*b* of the arcuate flexible internal compartments 102 for releasing the paintballs 101 when a force is exerted on the spring element 109. Consider the example of a user wishing to load the paintballs 101 to a paintball marker. When the user exerts pressure on the spring element 109, the second opening 102*b* opens to release the paintballs 101. When the user stop applying pressure, the spring element 109 rebounds to the decompressed state and the second opening 102*b* is closed.

The foregoing examples have been provided merely for the purpose of explanation and are in no way to be construed as limiting of the wearable paintball dispensing bag 100, disclosed herein. While the wearable paintball dispensing bag 100 has been described with reference to various embodiments, it is understood that the words, which have been used herein, are words of description and illustration, rather than words of limitation. Further, although the wearable paintball dispensing bag 100, have been described herein with reference to particular means, materials, and embodiments, the wearable paintball dispensing bag 100 is not intended to be limited to the particulars disclosed herein; rather, the wearable paintball dispensing bag 100 extend to all functionally equivalent structures, methods and uses, such as are within the scope of the appended claims. Those skilled in the art, having the benefit of the teachings of this specification, may effect numerous modifications thereto and changes may be made without departing from the scope and spirit of the wearable paintball dispensing bag 100*d* is closed herein in their aspects.

I claim:

1. A wearable paintball dispensing bag for storing a plurality of paintballs and loading the paintballs to a hopper of a paintball gun, the wearable paintball dispensing bag comprising:

a) one or more arcuate flexible internal compartments extends from a top section of the wearable paintball dispensing bag to a bottom section of the wearable paintball dispensing bag, wherein a first opening of the one or more arcuate flexible internal compartments is configured to receive the paintballs and a second opening of each of the one or more arcuate flexible internal compartments releases the paintballs;

b) one or more first fastening members positioned proximal to the second opening of the one or more arcuate flexible internal compartments for releasably sealing the second opening of the wearable paintball dispensing bag, wherein unfastening the one or more first fastening members releases the paintballs into the hopper of the paintball gun;

c) a plurality of pockets;

d) a plurality of pouches; and e) a plurality of auxiliary straps positioned on a front surface of the wearable paintball dispensing bag for holding a plurality of objects;

a spring element;

wherein said plurality of auxiliary straps are only on a surface opposite to a rear surface of the wearable paintball dispensing bag having a pair of shoulder straps thereon, therefore, the plurality of auxiliary straps do not include the pair of shoulder straps;

wherein the surface opposite to the rear surface of the wearable paintball dispensing bag has an entire width;

wherein the plurality of auxiliary straps do not extend across the entire width of the wearable paintball dispensing bag, but rather only a part thereof;

wherein said one or more first fastening members include one or more straps, respectively;

wherein said spring element is positioned proximal to said second opening of said one or more arcuate flexible internal compartments for releasing the paintballs when a force is exerted on said spring element; and wherein each strap of said one or more first fastening members extends axially forwardly from one side of a bottom section of an associated arcuate flexible internal compartment, transversely across an associated second opening that is already horizontally compressed by an associated spring element, and then axially rearwardly to the other side of said bottom section of said associated arcuate flexible internal compartment, to thereby releasably seal said associated second opening.

2. The wearable paintball dispensing bag of claim 1, further comprising a second fastening member positioned at the top section of the wearable paintball dispensing bag for sealing the first opening of the wearable paintball dispensing bag.

3. The wearable paintball dispensing bag of claim 2, wherein the one or more first fastening members and the second fastening member are one of a zipper, a hook and loop fastener, and a snap fastener.

4. The wearable paintball dispensing bag of claim 1, wherein a user contact surface is a back of a user.

* * * * *